United States Patent [19]

Ganci et al.

[11] 4,076,652

[45] Feb. 28, 1978

[54] ELASTIC RESISTOR COMPOSITIONS CONTAINING METALLIC-CONDUCTIVE PARTICLES AND CONDUCTIVE LUBRICANT PARTICLES

[75] Inventors: James Barry Ganci, Wilmington; Sebastian V. R. Mastrangelo, Hockessin, both of Del.

[73] Assignee: E. I. Du Pont de Nemours and Company, Wilmington, Del.

[21] Appl. No.: 689,387

[22] Filed: May 24, 1976

[51] Int. Cl.[2] ..... H01B 1/06

[52] U.S. Cl. ..... 252/504; 252/507; 252/511; 252/516

[58] Field of Search ..... 252/504, 507, 511, 516, 252/518.2; 338/114

[56] References Cited

U.S. PATENT DOCUMENTS

| | | | |
|---|---|---|---|
| 3,265,765 | 8/1966 | Holden et al. | 260/876 |
| 3,629,774 | 12/1971 | Crites | 338/114 |
| 3,648,002 | 3/1972 | Durocher | 338/114 |
| 3,806,471 | 4/1974 | Mitchell | 252/518 |
| 3,875,434 | 4/1975 | Harden et al. | 338/114 X |
| 3,912,668 | 10/1975 | Neumann et al. | 260/18 PN |

OTHER PUBLICATIONS

Condensed Chemical Dictionary (8th Ed.), p. 592.

*Primary Examiner*—Benjamin R. Padgett
*Assistant Examiner*—E. Suzanne Parr
*Attorney, Agent, or Firm*—James A. Costello

[57] ABSTRACT

Elastic resistor compositions comprising metallic-conductive particles and solid conductive lubricant particles codistributed in a matrix of a curable, elastomer-forming polymer and the cured compositions formed therefrom. Elastic resistors made from said compositions are also disclosed.

9 Claims, No Drawings

ELASTIC RESISTOR COMPOSITIONS CONTAINING METALLIC-CONDUCTIVE PARTICLES AND CONDUCTIVE LUBRICANT PARTICLES

BACKGROUND OF THE INVENTION

This invention concerns elastic resistor compositions in the curable and in the cured states, as well as elastic resistors made therefrom. The cured resistor compositions are characterized by good repeatability of response to recurrent pressure activation. The elastic resistors of this invention represent an improvement over elastic resistors containing conductive particles but lacking the conductive lubricant particles. It has been found that resistors to which conductive lubricant particles are added maintain a high standby resistance state and a low resistance state under pressure activation, even after many pressure activation cycles.

SUMMARY OF THE INVENTION

This invention concerns compositions comprising i. from 15 to 45 volume percent of metallic-conductive transition metal compound particles, said particles having a Knoop microhardness at 100 grams of applied load ($K_{100}$) of at least 500 kg/mm$^2$ and an electrical resistivity of less than 1000 microohm-cm, ii. from 4 to 30 volume percent of electrically conductive solid lubricant particles, said particles characterized by having lamellarly ordered, mobile crystalline planes and a bulk conductivity of at least about $10^{-3}$ reciprocal ohm-cm., the sum of (i) and (ii) being 25 to 55 volume percent, and iii. from 45 to 75 volume percent of elastomer.

Preferred solid lubricant particles are selected from at least one member of the group a. graphite, and the dichalcogenides:

b. the disulfides of zirconium, molybdenum, tungsten, niobium and tantalum, c. the diselenides of zirconium, molybdenum, tungsten, niobium and tantalum, and d. the ditellurides of zirconium, molybdenum, tungsten, niobium and tantalum.

Preferred compositions of this invention are those comprising (i) TiC and/or $TiSi_2$, (ii) graphite, and (iii) silicone rubber. The most preferred compositions of this invention are those comprising (i) TiC, (ii) graphite, and (iii) silicone rubber.

The compositions of this invention are (1) the cured particle-filled elastic resistor compositions, (2) the curable particle-filled elastic resistor compositions, as well as (3) elastic resistor devices comprising elastic resistor compositions having electrodes emplaced therein. For the sake of simplicity, the uncured elastomer (premix for the cured elastomer), as well as the cured elastomer, are included in the description of "elastomer."

The term"curing" employed herein refers to any operation which converts an elastomer-forming material into an elastomer and includes crosslinking by the formation of chemical bonds, evaporation of solvent, cooling, crystallization, or a combination of these.

The resistor compositions of this invention are characterized by good repeatability of response to the recurrent application of pressure, that is: with a given voltage applied across said resistor and a certain compressive force recurrently applied to and removed from the resistor, the currents which flow both with force applied and without force applied show very good resistance to change with time as shown by the "cyclic test" results summarized in Table 1.

DETAILS OF THE INVENTION

The Metallic-Conductive Particles (i)

The metallic-conductive particles useful herein are prepared from compounds of transition metals which have partially filled d-shells to favor covalent over ionic bonding. See, for instance, G. Hagg, Z. phys. Chem., B 6, pages 221-232 (1929) and P. Schwartzkopf and R. Kieffer, "Refractory Hard Metals," The Macmillan Company, N.Y. (1953), and G. V. Samsonov "High Temperature Materials No. 2 Properties Index," Plenum Press, N.Y. (1964). Included are compounds of transition elements from scandium to nickel, yttrium to ruthenium, lanthanum to platinum, including the rare earth elements, and the actinium series. Broadly included, then, are particles of compounds selected from Groups III to VIII in the periodic arrangement of the elements, which show conductivity like metals.

Representative compounds from which particles of this invention are derived include the following.

| Compounds Group III Borides | Resistivities (In Microohm-Cm) | Knoop Microhardness ($K_{100}$) (in Kg/mm$^2$) |
|---|---|---|
| $ScB_2$ | 7–15 | 1780 |
| $ScB_4$ | 750 | 4540 |
| $YB_6$ | 40.5 | 3264 |
| $LaB_6$ | 15.0 | 2770 |
| $CeB_6$ | 29.4 | 3140 |
| $PrB_6$ | 19.5 | 2470 |
| $NdB_4$ | 20.0 | 2540 |
| $SmB_6$ | 207 | 2500 |
| $EuB_6$ | 84.7 | 2660 |
| $GdB_6$ | 44.7 | 2300 |
| $TbB_6$ | 37.4 | 2300 |
| $YbB_6$ | 46.6 | 2660 |
| $ThB_6$ | 14.8 | 1740 |
| Group IV Borides | | |
| TiB | 40 | 2700–2800 |
| $TiB_2$ | 14.4 | 3370 |
| $ZrB_2$ | 16.6 | 2252 |
| $HfB_2$ | 8.8 | 2900 |
| Group V Borides | | |
| $VB_2$ | 3.5 | 2800 |
| NbB | 64.5 | 2195 |
| $NbB_2$ | 34.0 | 2600 |
| TaB | 100 | 3130 |
| $TaB_2$ | 37.4 | 2500 |
| Compounds Group IV Carbides | Resistivities (In Microohm-Cm) | Knoop Microhardness ($K_{100}$) (in Kg/mm$^2$) |
| Group VI Borides | | |
| CrB | 69 | 1200–1300 |
| $CrB_2$ | 84 | 2100 |
| $Cr_2B$ | 52 | 1350 |
| $Cr_4B$ | 176 | 1240 |
| $\alpha$-MoB | 45 | 2350 |
| $\beta$-MoB | 25 | 2500 |
| $MoB_2$ | 45 | 1200 |
| $Mo_2B$ | 40 | 2350 |
| $Mo_2B_5$ | 18 | 2350 |
| $W_2B_5$ | 43 | 2663 |
| Group III Carbides | | |
| ScC | 274 | 2720 |
| $YC_2$ | 88.7 | 708 |
| $Y_2C_3$ | 338 | 910 |
| ThC | 25 | 850 |
| $ThC_2$ | 30 | 600 |
| UC | 100 | 923 |
| Group IV Carbides | | |
| TiC | 52.5 | 3200 |
| ZrC | 50.0 | 2925 |
| HfC | 45.0 | 2913 |
| Group V Carbides | | |

-continued

| | | |
|---|---|---|
| VC | 65 | 2094 |
| NbC | 51.1 | 1961 |
| TaC | 42.1 | 1599 |
| Group VI Carbides | | |
| $Cr_3C_2$ | 75 | 1350 |
| $Cr_7C_3$ | 109 | 1336 |
| $Cr_{23}C_6$ | 127 | 1650 |
| $Mo_2C$ | 71.0 | 1499 |
| WC | 19.2 | 1780 |
| $W_2C$ | 75.7 | 3000 |
| Group IV Nitrides | | |
| TiN | 25 | 1994 |
| ZrN | 21.1 | 1520 |
| HfN | 33.0 | 1640 |
| Compounds | Resistivities | Knoop |
| Group V Nitrides | (In Microohm-Cm) | Microhardness ($K_{100}$) (in $Kg/mm_2$) |
| VN | 85.0 | 1520 |
| $V_3N$ | 123.0 | 1900 |
| NbN | 78.0 | 1396 |
| $Nb_2N$ | 142.0 | 1720 |
| $NbN_{0.75}$ | 90.0 | 1780 |
| $NbN_{0.97}$ | 85.0 | 1525 |
| TaN | 128.0 | 1060 |
| $Ta_2N$ | 263.0 | 1220 |
| Group VI Nitrides | | |
| CrN | 640 | 1093 |
| $Cr_2N$ | 84 | 1571 |
| $Mo_2N$ | 19.8 | 630 |
| Group III Silicides | | |
| $CeSi_2$ | 408 | 540 |
| Group IV Silicides | | |
| TiSi | 63 | 1039 |
| $TiSi_2$ | 16.9 | 892 |
| $ZrSi_2$ | 75.8 | 1063 |
| Group V Silicides | | |
| $VSi_2$ | 66.5 | 890–960 |
| $V_3Si$ | 203.5 | 1430–1560 |
| $V_5Si_3$ | 114.5 | 1350–1510 |
| $NbSi_2$ | 50.4 | 1050 |
| $TaSi_2$ | 46.1 | 1407 |
| Group VI Silicides | | |
| CrSi | 129.5 | 1005 |
| $CrSi_2$ | 914 | 704 |
| $Cr_3Si$ | 35 | 1005 |
| $Cr_3Si_2$ | 80 | 1280 |
| $MoSi_2$ | 21.6 | 707 |
| $Mo_3Si$ | 21.6 | 1310 |
| $Mo_5Si_3$ | 45.9 | 1170 |
| $WSi_2$ | 12.5 | 1074 |
| Group VIII Silicides | | |
| $CoSi_2$ | 68 | 552 |
| $NiSi_2$ | 118 | 1019 |

From the standpoint of ease of preparation and availability, compounds of Group IV to VI transition metals with small non-metal atoms such as carbon, nitrogen, silicon, boron, and germanium are preferred for use in this invention. Preferred for attaining resistance response over a wide range of pressures are titanium carbide and titanium disilicide. Titanium carbide is especially preferred.

Metallic-conductive particles of 0.1 to 50 microns in their largest dimension, preferably 5 to 20 microns, are suitable for use in this invention. Some small proportion of particles having their dimensions outside this range can be employed, it being appreciated however that excessively large particles are to be avoided. Normal grinding procedures have been found to produce the rough particles that are preferred. The contemplated metallic-conductive particles do not exhibit yield points and have a high ultimate strength, in excess of 30,000 psi, which allows the particles to withstand inter-particle stress under pressure. The ultimate strength of the most preferred transition metal compound, titanium carbide, is 124,000 psi.

Electrically Conductive Solid Lubricant Particles (ii)

Contemplated lubricant particles include materials which have lamellar ordering and weak bonding between adjacent crystalline planes. They typically have relatively weak van der Waals bonds between planes that are easily broken by applied pressure, allowing movement of plane over plane. The lubricant particles must be electrically conductive in cooperation with the metallic-conductive particles since poor results are obtained with good lubricating but poorly conducting materials such as solid organic fluorocarbon lubricant. The bulk conductivity of the lubricant particles is normally at least about $10^{-3}$ reciprocal ohm-cm, although comminuted submicron particles of lower conductivity may be sufficiently conductive for certain uses.

Suitable materials for this invention include graphite and dichalcogenides of Group IVB, VB, VIB metals of the Periodic Table such as disulfides, diselenides, and ditellurides of zirconium, molybdenum, tungsten, niobium, and tantalum which have bulk electrical conductivities from about $2 \times 10^3$ to $10^{-3}$ reciprocal ohm-cm. Their lamellarly ordered, mobile crystalline plane structure, preparation, electrical properties, and utility as dry solid lubricants are well known. See, for example, I.E.E.E. Transactions on Aerospace, Vol. II, No. 2, April, 1964, pp. 457 to 466.

Graphite is the preferred lubricant. However, graphitized carbon and conductive thermal blacks such as finely divided conductive acetylene black, can also be used. Poor results are obtained with less conductive amorphous carbon blacks commonly used as reinforcing fillers for rubber. Without meaning to be bound by any theory of how the invention operates, it is thought that perhaps the lubricant particles form renewable conductive bridges between the metallic-conductive particles.

Lubricants contemplated to be employed in this invention are available commercially. Their average particle sizes are usually from about 0.01 $\mu$M to 100 $\mu$M. One skilled in the art will appreciate that the particle sizes can be somewhat affected by the manner of incorporation into the elastomer.

Elastomer (iii)

The contemplated elastomers exhibit normal elastomer recovery; that is, they are capable of being elongated at least 20% (ASTM D-412-61T test), usually between 20% and 50%, and still retract to essentially their original length. The elastomer functions as a continuous dielectric matrix in which a relatively large volume fraction of particles can be insulatively distributed to achieve a relatively high standby resistance. The elastomer ordinarily will be sufficiently insulative, even if additives are present, to prevent current by-pass around particles.

Useful elastomer-forming compositions broadly encompass preformed polymers and mixtures of preformed polymers with cross-linking agents, which are self-curing or contain a curing agent can also be used.

For convenience in handling, the polymer or composition containing the polymer is normally liquid of suitable viscosity for mixture with the particles. Volatile solvents can be used adjust viscosity as desired. The compositions of this invention can be prepared by incorporating the particles into the polymer in any convenient manner including by hand or on a standard rubber mill or in a Banbury mixer.

The amount of mechanical work done in incorporating the particles of this invention into the elastomer has a considerable influence on the characteristics of the resulting elastic resistor. Specifically, the greater the amount of mechanical work, the lower the value of $k$ for the elastic resistor; see the equation below in the discussion of volume fractions of (i), (ii) and (iii). When it is desired that $k$ shall have a high value, it is desirable to minimize the amount of work done in mixing. Under these circumstances, it is believed that the elastomer will not wet all of the surfaces of the particles, especially, the metallic-conductive particles. Rather, the resulting elastic resistor will contain some conductive particles separated from each other only by air.

Representative elastomers of this invention include the following typical "rubbers" and "elastomers": natural rubber and synthetic elastomers such as cis-1,4-polyisoprene rubber; styrene-butadiene rubbers (SBR) marked by random sequences of the two monomers in chains for rubberlike behavior; ethylene-propylene rubbers which are copolymers containing a few percent copolymerized diene monomer for unsaturation; neoprene rubber, which consists mainly of trans-1,4-polychloroprene; silicone rubbers having chemically crosslinked Si-O-Si chains; fluoro-rubber counterparts of nonfluorinated source material, e.g., fluorinated silicones; fluorolefin rubbers such as copolymers of vinylidene fluoride and hexafluoropropene; urethane elastomers in which short polyether and polyester hydroxyl-terminated chains are extended and crosslinked, e.g., by reaction with di- or polyfunctional isocyanates; and thermoplastic elastomers which are ordered, block copolymers of segmented A-B-A structure, A being thermoplastic, B being elastomeric.

Preferred elastomers are those can be used in combination with many kinds of particles. Silicone elastomers are preferred for this reason, particularly room-temperature vulcanizable (RTV) silicone rubber curable by moisture or by catalysts. Silicone elastomers are also preferred for their retention of elastic properties in devices such as those disclosed in coassigned U.S. Pat. No. 3,875,434 having utility as crash sensors which are exposed to low temperatures.

One preferred elastomer comprises a compound of (1) at least 90% by weight of a substantially difunctional, linear, extensively pre-condensed but not resinous organosiloxane polymer of the general formula $$XO\text{-}Si(R)_2\text{—}[O\text{-}SiR_2]_n\text{—}O\text{-}Si(R)_2\text{—}OX$$

in which R represents an alkyl or aryl radical, such as a methyl, ethyl, or phenyl; X represents hydrogen or R, and n is a whole number of at least 50, and (2) about 0.5 to 10% by weight of a polyfunctional organosilicon compound containing more than two functional groups, which compound is either an organosilicon compound of the general formula $R_mSiX_{4-m}$ in which R is an alkyl or aryl radical, X is a reactive group capable of condensation such as a hydroxyl, alkoxy, aryloxy or amino group and $m$ is a number from 0 to below 2 (including fractional numbers) or the corresponding siloxane. Such silicone rubber systems are described in more detail in U.S. Pat. No. 3,127,363.

Liquid room temperature vulcanizable (RTV) silicone rubber compounds of this type are simple and convenient to handle and are available commercially from several suppliers as one package of a two-package formulation, the other package containing a curling agent comprising catalytically active metal soap, metal chelate, metal salt of a thiol or dithiocarbamic acid, metal oxide, organo-metal compound, organic base, or acid, as described in U.S. Pat. No. 3,127,363.

Other suitable elastomers which are normally liquid before curing include those which are condensation-curable when exposed to atmospheric moisture, e.g., RTV compounds made by mixing in the absence of moisture, a hydroxylated siloxane polymer, a silane and a beta-dicarbonyl titanium compound as described in U.S. Pat. No. 3,334,067, column 2, lines 16 to 58 and following. Curing of these compounds is dependent upon slow diffusion of moisture into the rubber.

Another suitable liquid carrier system for the particulate components of the invention composition comprises elastomer block polymers having the general formula A-B-A wherein each A is an independently selected nonelastomeric polymer block having an average molecular weight of 2,000 to 100,000 and a glass transition temperature above about 25° C, and B is an elastomeric polymer block having an average molecular weight between about 25,000 and 1,000,000 and a glass transition temperature below about 10° C, said block polymer being solubilized in an aliphatic or aromatic liquid hydrocarbon solvent such as heptane or toluene. Upon casting and removing the solvent by evaporation, a resilient elastoplastic having high elongation is formed whose strength is gained from physical crosslinks rather than chemical crosslinks. Thus, vulcanization in the usual sense is not required.

Included among the contemplated elastomeric block copolymers are those wherein the elastomer polymer block is a conjugated diene such as butadiene and the nonelastomeric polymer block is styrene, as described in U.S. Pat. No. 3,265,765. Such a polymer system is useful herein in formulating an especially convenient, single package composition which is processed by solvent evaporation. Alternatively, such copolymers, being thermoplastic, can be compounded with the metallic-conductive particles and lubricant particles without solvent in a heated mill or mixer. Thus, the compositions of this invention can be either one package of a two-package system or a single package complete by itself and may be convertible by various means within the skill of the art.

Utility

When a given voltage is applied across a resistor prepared as will be described in more detail later, the resulting current varies with compressive force applied to the resistor approximately as given by the following equation:

$$i = i_o + kF^2$$

where $i$ = observed current $i_o$ = current when no force is applied $k$ = constant determined by geometry and compositional parameters, e.g., volume percentage of particles $F$ = applied force $s$ = sensitivity constant.

The sensitivity constant, $s$, is dependent upon the amount of lubricant particles in the sample. When the amount of such particles is high, e.g., 15% to 30% by volume, $s$ tends to be low, typically in the range of 1.5 to 2. Conversely, when the proportion of such particles is low, e.g., near 5% by volume, s tends to be high typically 3 or greater.

On the other hand, high proportions of lubricant particles lead to better repeatability of pressure response. Thus, while all the compositions of this invention show a high degree of repeatability of pressure response, the best degree of repeatability of pressure response tends to be shown by the compositions with the highest content of lubricant particles.

The upper limit of the total amount of metallic-conductive and lubricant particles is set, not by the electrical characteristics of the resulting resistive elastomeric material, but by its physical properties. When high amounts of particles are used, mixing the components becomes difficult and the mixtures tend to be crumbly. Frequently, such mixtures can, with careful handling, be converted into useful elastic resistors. As the amount of particles is further increased, however, there comes a point where formation of a coherent elastic resistor is no longer possible. This sets the upper limit of the amounts of particles useful in this invention.

From these considerations, it is obvious that the upper limit of amounts of particles usable in a given case will depend on several parameters. Among these are: the nature of the elastomer, the presence and amount of dispersed solids in the elastomer, and the particle sizes.

Devices

Devices and articles of manufacture are fabricable from the elastic resistor compositions described herein. In an article of manufacture employing an elastic resistor as a sensor element, the improvement of this invention comprises use of resistor as described herein as a current-controlling component. Current-control is effected by its response to applied pressure as described herein.

The usual shape of the elastic resistors of this invention is a flat sheet of the cured elastic resistor composition with electrodes emplaced thereon. The electrodes can be emplaced during or after curing of the resistor composition. The electrodes can be permanently emplaced upon (bonded to) the resistor composition with the aid of an adhesive or after elastomer cure; or, they can be bonded to the elastomer, without the aid of an adhesive, during elastomer cure. In this latter circumstance, the elastomer bonds to the electrode without need for an (auxiliary) adhesive. Alternatively, the electrodes can be emplaced upon (but not bonded to) the elastic resistor composition. It is preferred, however, that the electrodes be bonded to the resistor composition and it is most preferred that bonding be effected by use of an auxiliary adhesive during curing of the resistor composition.

Suitable electrodes are formed from base metals such as aluminum, copper, and german silver, as well as from noble metals such as silver and gold. The ability to function well with bonded or unbonded electrodes of base metal constitutes an advantage of the elastic resistors of this invention over those of the prior art.

While curing in a thin sheet is usually the most convenient way to shape the elastic resistor material, it is also possible to cure it in any convenient shape and cut the cured resistive material to the shape desired for use. Likewise, the electrodes can be of any shape. In some instances, it is desirable to locate both electrodes on the same side of an elastic resistor in sheet form.

One shape of elastic resistor sometimes quite useful in a keyboard is that of a slender pillar. The resistor and key are arranged so that force is applied in the direction of the axis of the pillar, which forces the pillar to bow. The electrodes are located at the ends of the pillar. This distortion is as effective as compressive force and causes the resistor to permit more current to flow.

When an elastic resistor of this invention is used in the form of a layer, the thickness chosen for the layer can vary widely depending on the intended use and upon the size of the particles. Usually, the thickness will be in the range of 1 to 10,000 microns, and preferably, 100 to 2,000 microns.

The elastic resistors of the invention are useful in controlling electrical current in associated circuitry. Thus, they can be used in keyboards for calculators or electric typewriters, floor mat sensors, weighing systems, switch systems for areas where sparking is dangerous on account of explosive atmospheres, and the like.

In the following Examples, all parts are based on weight unless otherwise specified. The mixing of the Examples was accomplished by hand using a wooden paddle. In all cases, the minimum mixing required to achieve a visually homogeneous product was used.

In Examples 1, 5, 6, 8 and 9, clean aluminum electrodes for forming resistors were prepared by degreasing, removing oxide by standard etching with chromic acid solution, and applying a thin coating of a metal bonding primer (SS-4120 RTV Silicone Primer, General Electric) understood to be a monomeric, hydrolyzable silane reactive with hydroxyl groups on a metal surface. In Examples 2, 3, 4 and 7 clean aluminum electrodes were prepared by degreasing, power wirebrushing, and applying the primer.

EXAMPLE 1

A curable composition was prepared by mixing 21 grams of titanium carbode (TiC) power (about 20 micron average particle size) and 7.5 grams of graphite powder with 15 grams of liquid silicone rubber compound ("Silastic" G, Dow Corning) understood to be a low molecular weight silicone polymer with a silanol end group admixed with an alkoxy-containing crosslinking agent.

A 14.5 gram portion of the relatively thick pasty TiC- and lubricant-filled mixture was placed in a 10 ml wide mouth bottle to serve as package A of a two-package system. A 0.75 gram portion of the catalytic curing agent, dibutyl tin diacette, having a mineral oil-like consistency was placed in a small vial to serve as package B, the amount being 50% in excess of the recommended proportion of catalyst as compensation for anticipated holdup in the vial upon pouring from B into A.

During storage the conductive materials in A remained suspended without noticeable settling. To initiate curing, B was poured into A and mixed with A. The mixture of A and B was placed between two sheets of aluminum 50 mls thick separated by a polytetrafluoroethylene spacer 50 mils thick and having a 7/16 inch square aperture which defined the casting. After curing had proceeded long enough at room temperature for handling, the material was removed from the mold. It consisted of the elastic resistor bonded to two aluminum electrodes in a "sandwich" structure. Curing was continued at room temperature for a total of 72 hours.

Volume percentages of metallic-conductive particles, elastomer, and graphite in the elastic resistor were 20.1, 64.2 and 14.7% respectively.

Cyclic Test Procedure

The elastic resistor of this Example was then subjected to a "cyclic test." In this test, the resistor was connected across a potential of 5 volts through a sensitive recording ammeter. It was then cycled between a compressed state and a relaxed state. The force applied in the compressed state is recorded in Table 1; in each case, the force applied in the relaxed state was between 0.5 lb and 0.7 lb. The current observed is recorded in Table 1 along with the corresponding cycle number.

In several cases, the force chosen for the first few cycles was insufficient to operate the elastic resistor in the desired manner, so that force was increased in the course of the test. Where this was done, the preliminary lower-force cycles are recorded in the introduction to Table 1.

In the cyclic tests, all samples were 7/16 inch square, 50 to 100 mils thick. The strain rate employed, both for applying and relieving the compressive force was 20 mils/min, and the observed maximum strain was between 5 and 10 mils.

As a result of the cyclic test, the curable composition of this Example was judged to be suitable for use in forming keyboard switches for pocket calculators equipped with appropriate logic means to discriminate between the relatively low and high currents passed by the elastic resistor upon compression and release. Such switches are considered particularly suitable for use as sensors with complementary metal oxide semiconductor (CMOS) transistor-transistor logic (TTL) which provides switching at a threshold current of about one milliampere.

EXAMPLE 2

A curable composition was prepared by mixing 2.5 parts of TiC power (3 to 6 micron average particle size), 1.0 part of the silicone rubber compound of Example 1, and 0.5 part of graphite powder. Curing was then initiated by adding the catalytic curing agent specified in Example 1 in the amount of 10% of the weight of the silicone rubber compound component and mixing. The mixture including the catalytic curing agent was then placed between two sheets of degreased, wire-brushed aluminum separated by the polytetrafluoroethylene spacer of Example 1 and cured as described in Example 1. The resulting elastic resistor contained volume percentages of TiC particles, silicone elastomer, and graphite of 31, 55.5 and 13.5% respectively.

COMPARATIVE EXAMPLE A

A curable composition and elastic resistor similar to that of Example 2 but without graphite was prepared with 3.75 parts of TiC powder (3 to 6 micron average particle size) and 1.0 part of the rubber compound of Example 2. The elastic resistor obtained for comparison with that of Example 2 contained by volume about 45% TiC particles and 55% silicone elastomer. Thus, the elastic resistor of Example 2 has about two-thirds the volume of TiC as does Comparative Example A, the remaining one-third having been replaced by graphite.

The cyclic test described in Example 1 was conducted on the elastic resistors of Examples 2 and A. As shown in Table 1, the elastic resistor of Example 2 has better repeatability of pressure response than does the resistor of Example A.

EXAMPLE 3

A curable composition was prepared and cured as in Example 1 using a very finely divided conductive acetylene black instead of graphite. Because of its fine particle size only about one-third the volume employed in Example 1 could be worked into the composition with the metallic-conductive particles and elastomer, the volume percentages of metallic particles, elastomer, and acetylene black being 22.2, 71.6, and 6.2% respectively in the cured product. Even with such a small amount of acetylene black an elastic resistor prepared by applying aluminum electrodes and curing as in Example 1 showed good repeatability of pressure response.

COMPARATIVE EXAMPLE B

A curable composition was prepared and cured as in Example 1 using an amorphous carbon black instead of graphite. A commercially available bituminous black having an average particle size of 2.5 microns and a bulk density of 1.22 was chosen so that loadings comparable to graphite would be possible. Accordingly, the volumes of metallic-conductive particles and elastomer used in Example 1 were achieved.

Upon forming the cured product with bonded electrodes as in Example 1 no detectable current (less than $10^{-5}$ milliamperes) was obtained. It was observed that the resistance was too high (over $10^8$ ohms) in the compressed state for practical elastic resistor applications. This failure was attributed to the use of the relatively nonconductive, nongraphitized carbon black.

EXAMPLE 4

A curable composition was made by combining 5.0 grams of TiC powder (about 20 micron average particle size), 2.0 grams of graphite powder, and 4.0 grams of the liquid silicone compound of Example 1. This mixture was cured as described in Example 1. The cured composition contained 18.3, 65.5 and 16.1 volume percent, respectively, of metallic-conductive particles, elastomer, and graphite. The composition was subjected to extensive cyclic testing for repeatability of pressure response as described in Example 1, except that a force of 36 lbs was used in the compressed state. As Table 1 shows, current in the relaxed state during each cycle was less than 0.01 ma. The curable composition is suitable for use in forming keyboard switches.

EXAMPLE 5

A composition was prepared using a commercially available, elastoplastic liquid polymer system which does not require vulcanization. Twenty grams of a block copolymer of styrene and butadiene ("Kraton" 1101 Thermoplastic Rubber, Shell), was dissolved in 140 ml of toluene. A composition of this invention curable by solvent removal was then prepared by mixing 1.4 grams of the TiC powders and 0.5 gram of the graphite used in Example 1 with 6.30 grams of the prepared liquid polymer solution.

The curable composition was cast and the toluene solvent was removed by evaporation to form a 50-mil thick film of cured product 1/2 inch square (19.6% TiC/65.1% elastomer/15.3% graphite by volume). The film was placed between aluminum electrodes and subjected to the cyclic test as described in Example 1. It was concluded from the force and peak current that the curable composition was suitable for use in making high current, low force keyboard switches.

EXAMPLE 6

A curable composition was prepared with a relatively large volume of $MoSe_2$ by mixing 3.8 grams of TiC (about 20 micron average particle size) and 4.0 grams of $MoSe_2$ with 2.0 grams of a liquid silicone rubber similar in composition to that used in Example 1, the silicone rubber being sold as SWS-04478 by Stauffer Chemical Co. The volume percentages of TiC, silicone rubber, and $MoSe_2$ used were 24.4, 57.3, and 18.3% respectively. The composition was cured by mixing with the 5% catalyst (as supplied) and standing for seven days at room temperature.

Electrodes were provided as in Example 1. The resultant elastic resistor showed good repeatability of pressure response. The peak current under 56 lbs of force increased and stabilized near 0.04 milliamperes between 20 and 40 cycles.

EXAMPLE 7

A mixture of 9.0 grams of TiC (about 20 micron average particle size) and 6.0 grams of $MoS_2$ with 5.0 grams of the liquid silicone rubber compound specified in Example 1 and molded and cured as in Example 1 provided volume percentages of TiC, silicone rubber, and $MoS_2$ which were 24.1, 59.5, and 16.4%, respectively. The elastic resistor showed good repeatability of pressure response in cyclic testing.

EXAMPLE 8

A curable composition was prepared by mixing 2.75 parts of $TiSi_2$ powder (1 to 5 micron average particle size), 1.0 part of the silicone rubber compound of Example 1, and 0.25 part of graphite powder. Curing was then initiated by adding the catalytic curing agent specified in Example 1 in the amount of 10% of the weight of the silicone rubber compound component. The mixture was then molded and cured as in Example 1. The resulting elastic resistor contained volume percentages of $TiSi_2$ particles, silicone elastomer, and graphite of about 38, 55, and 7%, respectively.

COMPARATIVE EXAMPLE C

A curable composition and elastic resistor similar to that of Example 8 but without graphite was prepared with 3.5 parts of $TiSi_2$ powder (1 to 5 micron average particle size) and 1.0 part of the rubber compound of Example 8. The elastic resistor obtained for comparison with that of Example 8 contained by volume about 46% of $TiSi_2$ particles, and 54% of silicone elastomer.

Accordingly, the elastic resistor of Example 8 has about 85% of the volume of $TiSi_2$ in the elastic resistor of Comparative Example C, the remaining 15% having been replaced by graphite. As shown in Table 1, currents in the compressed state of the elastic resistor of this invention made with graphite (Example 8) showed desirable repeatability of pressure response in contrast to that of Example C.

EXAMPLE 9

A curable composition was prepared with a large combined amount (49% by volume) of the TiC and graphite powder of Example 2 in the liquid silicone rubber of Example 2 by handling the mixture during blending as follows. The silicone rubber was poured onto moving rolls of a standard 2 inch by 6 inch rubber mill (W. R. Thropp & Sons) and a preblended mixture of TiC and graphite powders was added to the liquid rubber using a scraper blade to continuously transfer material toward the central portion of the rolls. Mixing on the rolls was stopped as soon as the material on the rolls looked homogeneous, the final portion of preblended powders being sufficient to subsequently bring the volume percentages of TiC, silicone rubber, and graphite to 36%, 51% and 13%, respectively, in the cured elastic resistor product.

The mixture formed on the rolls was removed with the scraper blade, molded and cured as in Example 1 to form an electroded elastic resistor.

TABLE 1

Summarized in Table 1 are the results of the cyclic tests run in accordance with the procedure given in Example 1; the tests having been run on the compositions of Examples 1 through 9 and Comparative Examples A, B and C. The number of "preliminary cycles" employed in each case is as follows: Example 1 (2), Example 2 (18), Example A (14), Example 3 (39), Example B (0), Example 4(0), Example 5 (7), Example 6 (0), Example 7 (4), Example 8 (15), Example C (0), Example 9 (1).

TABLE 1

| Cyclic Test Results | | | | |
|---|---|---|---|---|
| Example No. or Comparison Letter | Lbs. Force | Cycle Number | Current (ma) Compressed State | Current (ma) Relaxed State |
| 1 | 23.5 | 1 | 1.7 | 0.08 |
| | | 2 | 1.9 | 0.08 |
| | | 6 | 1.9 | 0.08 |
| | | 17 | 1.7 | 0.08 |
| | | 23 | 1.6 | 0.08 |
| | | 48 | 1.6 | 0.08 |
| 2 | 8.9 | 1 | 5.1 | <0.01 |
| | | 22 | 3.1 | <0.01 |
| | | 42 | 2.1 | <0.01 |
| | | 72 | 1.6 | <0.01 |
| A | 11.3 | 1 | 2.7 | <0.02 |
| | | 2 | 4.1 | <0.02 |
| | | 4 | 1.2 | <0.02 |
| | | 8 | 0.25 | <0.02 |
| | | 9 | 0.15 | <0.02 |
| 3 | 46.5 | 1 | 0.02 | <0.001 |
| | | 21 | 0.025 | <0.001 |
| | | 41 | 0.02 | <0.001 |
| | | 81 | 0.015 | <0.001 |
| B | 75 | All | $10^{-5}$ | $<10^{-5}$ |
| 4 | 36 | 1 | 0.3 | <0.01 |
| | | 2 | 0.8 | <0.01 |
| | | 3 | 1.1 | <0.01 |
| | | 4 | 1.4 | <0.01 |
| | | 6 | 1.8 | <0.01 |
| | | 8 | 2.1 | <0.01 |
| | | 10 | 2.1 | <0.01 |
| | | 20 | 2.4 | <0.01 |
| | | 50 | 2.6 | <0.01 |
| | | 500 | 1.8 | <0.01 |
| | | 1400 | 0.8 | <0.01 |
| | | 4000 | 0.7 | <0.01 |
| 5 | 5.4 | 1 | 120 | 2 |
| | | 18 | 105 | 3 |
| | | 53 | 88 | 3 |
| 6 | 56 | 1 | 0.010 | <0.0001 |
| | | 10 | 0.025 | <0.0001 |
| | | 20 | 0.036 | <0.0001 |
| | | 30 | 0.040 | <0.0001 |
| | | 40 | 0.040 | <0.0001 |
| 7 | 41 | 1 | 0.068 | <0.0001 |
| | | 16 | 0.065 | <0.0001 |
| | | 36 | 0.050 | <0.0001 |
| | | 66 | 0.040 | <0.0001 |
| 8 | 51 | 1 | 23.5 | <0.1 |
| | | 2 | 30 | <0.1 |
| | | 3 | 34 | <0.1 |
| | | 4 | 36 | <0.1 |
| | | 5 | 37.5 | <0.1 |
| | | 7 | 45 | <0.1 |
| | | 10 | 39 | <0.1 |
| | | 15 | 41 | <0.1 |
| | | 20 | 21 | <0.1 |
| | | 25 | 10 | <0.1 |
| | | 30 | 7 | <0.1 |

TABLE 1-continued

| Example No. or Comparison Letter | Cyclic Test Results | | | |
|---|---|---|---|---|
| | Lbs. Force | Cycle Number | Current (ma) Compressed State | Current (ma) Relaxed State |
| C | 60 | 1 | 8 | <0.1 |
| | | 2 | 11.8 | <0.1 |
| | | 3 | 4 | <0.1 |
| | | 4 | 1 | <0.1 |
| | | 5 | 0.2 | <0.1 |
| | | 7 | 0.03 | <0.1 |
| 9 | 30 | 2 | 0.10 | <0.1 |
| | | 5 | 0.30 | <0.1 |
| | | 10 | 0.61 | <0.1 |
| | | 15 | 0.65 | <0.1 |
| | | 20 | 0.64 | <0.1 |

The embodiments of this invention for which an exclusive property or privilege is claimed are defined as follows:

1. An elastic resistor composition comprising:

i. from 15 to 45 volume percent of metallic-conductive transition metal compound particles, said particles having a Knoop microhardness at 100 grams of applied load ($K_{100}$) of at least 500 kg/mm$^2$ and an electrical resistivity of less than 1000 microohm-cm, ii. from 4 to 30 volume percent of electrically conductive graphite particles having lamellarly ordered, mobile crystalline planes and a bulk conductivity of at least about $10^{-3}$ reciprocal ohm-cm, the sum of (i) and (ii) being 25 to 55 volume percent, and iii. from 45 to 75 volume percent of elastomer.

2. An elastic resistor composition of claim 1 wherein the metallic-conductive particles are TiC.

3. An elastic resistor composition of claim 1, wherein the metallic-conductive particles are $TiSi_2$.

4. An elastic resistor composition of claim 1 wherein the elastomer is selected from silicone rubber and A-B-A block copolymers.

5. An elastic resistor composition of claim 4 wherein the elastomer is silicone rubber.

6. An elastic resistor composition of claim 4 wherein the elastomer is A-B-A block copolymer of styrene and butadiene.

7. An elastic resistor composition of claim 5 wherein the metallic-conductive particles are TiC.

8. An elastic resistor device comprising the elastic resistor composition of claim 1 within emplaced electrodes.

9. An elastic resistor device of claim 8 wherein the electrodes are bonded to the composition of claim 1.

* * * * *